US011987428B2

(12) United States Patent
Youell

(10) Patent No.: US 11,987,428 B2
(45) Date of Patent: May 21, 2024

(54) PARTITIONED CONTAINER

(71) Applicant: DRYIP, LLC, Dublin, OH (US)

(72) Inventor: D. Rudolph Youell, Dublin, OH (US)

(73) Assignee: DRYIP, LLC, Dublin, OH (US)

( * ) Notice: Subject to any disclaimer, the term of this patent is extended or adjusted under 35 U.S.C. 154(b) by 0 days.

(21) Appl. No.: 17/459,690

(22) Filed: Aug. 27, 2021

(65) Prior Publication Data

US 2022/0297876 A1 Sep. 22, 2022

Related U.S. Application Data

(63) Continuation-in-part of application No. 17/208,650, filed on Mar. 22, 2021, now Pat. No. 11,623,784.

(51) Int. Cl.
*B65D 5/49* (2006.01)

(52) U.S. Cl.
CPC ..... *B65D 5/48038* (2013.01)

(58) Field of Classification Search
CPC ..... B65D 5/48038; B65D 5/48048; B65D 5/6608; B65D 5/0254; B65D 5/0209; B65D 5/029; B65D 5/2014; B65D 5/2033
USPC ..... 229/120.36, 120.31, 120.37, 120.38, 229/108–114
See application file for complete search history.

(56) References Cited

U.S. PATENT DOCUMENTS

| | | | | |
|---|---|---|---|---|
| 284,252 A | | 9/1883 | Smith | |
| 345,510 A | | 7/1886 | Jenkins et al. | |
| 347,835 A | | 8/1886 | Shibley | |
| 449,330 A | | 3/1891 | Perkins | |
| 682,646 A | * | 9/1901 | Scheuer | B65D 5/48038 217/31 |
| 747,518 A | | 12/1903 | Ward | |
| 1,120,752 A | * | 12/1914 | Smiley | B65D 5/48038 229/120.36 |
| 1,313,948 A | | 8/1919 | Maegly | |
| 1,767,629 A | | 6/1930 | Walter | |
| 2,284,385 A | | 5/1942 | Freshwaters | |
| 2,337,468 A | | 12/1943 | Hilger | |
| 2,448,795 A | | 9/1948 | Grecco | |
| 2,663,491 A | * | 12/1953 | Hill | B65D 5/10 229/157 |
| 2,706,935 A | * | 4/1955 | Pasjack | B65D 5/48038 229/120.31 |
| 2,709,547 A | | 5/1955 | Niedringhaus | |
| 2,734,626 A | | 2/1956 | Koester et al. | |
| 2,741,362 A | | 4/1956 | Cortright | |

(Continued)

FOREIGN PATENT DOCUMENTS

| | | | | |
|---|---|---|---|---|
| FR | 1417280 A | | 11/1965 | |
| GB | 1508839 A | * | 4/1978 | B65D 5/48038 |
| WO | 2011010242 A1 | | 1/2011 | |

*Primary Examiner* — Christopher R Demeree
*Assistant Examiner* — Phillip D Schmidt
(74) *Attorney, Agent, or Firm* — Standley Law Group LLP; Jeffrey S. Standley; Bryan P. Finneran

(57) ABSTRACT

A partitioned container having a plurality of individual compartments formed from mated slotted interior panels. One or more exterior panels surround the mated interior panels to form the outside of the partitioned container. The interior panels may include folding tab sections and partitioning sections, and the panels may be mated with one another through a self-locking mechanism. The various panels may be folded about fold lines to permit the assembly to be folded into a substantially flat state.

14 Claims, 6 Drawing Sheets

(56) References Cited

U.S. PATENT DOCUMENTS 2,776,745 A 1/1957 Antwerpen
2,806,592 A 9/1957 Hatfield
2,807,360 A 9/1957 Nurre
2,919,022 A 12/1959 Lidgard
2,967,009 A 1/1961 Lidgard
3,028,001 A 4/1962 Gleim
3,043,488 A 7/1962 Warwick
3,044,615 A 7/1962 Richardson
3,166,188 A 1/1965 Koester
3,363,753 A 1/1968 Taylor
3,389,785 A 1/1968 Lidgard
3,385,462 A 5/1968 Deldime et al.
3,403,778 A 10/1968 Voytko et al.
3,414,124 A 12/1968 Lidgard
3,519,244 A 7/1970 Lidgard
3,557,719 A 1/1971 Gielas
3,756,397 A 9/1973 Ganz
3,878,943 A 4/1975 Ryan et al.
3,880,343 A 4/1975 Rockefeller
3,884,356 A 5/1975 Lidgard
3,900,157 A 8/1975 Roth
3,904,105 A 9/1975 Booth
3,930,438 A * 1/1976 Hackman ..... B31B 50/81 493/379
3,942,709 A 3/1976 Gepfer
3,990,576 A 11/1976 Heaney
3,995,736 A 12/1976 Lawson et al.
4,000,845 A * 1/1977 Zeller ..... B65D 5/48038 229/120.36
4,085,847 A 4/1978 Jacalone
4,090,918 A * 5/1978 Masetti ..... G21C 3/3563 376/442
4,225,043 A 9/1980 Lastik
4,287,990 A 9/1981 Kurick
4,306,653 A 12/1981 Fales
4,572,425 A 2/1986 Russell
4,697,699 A 10/1987 Scheider
4,785,957 A 11/1988 Beck et al.
4,805,774 A 2/1989 Salisbury
4,875,419 A 10/1989 Helton et al.
4,899,880 A 2/1990 Carter
4,930,632 A 6/1990 Eckert et al.
4,945,689 A * 8/1990 Johnson, Jr. ..... E01C 11/16 52/668
5,004,146 A 4/1991 Thominet et al.
5,101,976 A 4/1992 Salisbury
5,111,937 A 5/1992 Schutz
5,150,646 A 9/1992 Lonczak
5,269,422 A 12/1993 Chevrette
5,332,149 A 7/1994 Gepfer
5,441,154 A 8/1995 Youell, III
5,531,165 A 7/1996 Taravella et al.
5,595,301 A 1/1997 Putz et al.
5,671,857 A 9/1997 Stromberg
5,758,818 A 6/1998 Ewing, Jr.
5,785,239 A 7/1998 Campbell, II et al.
5,873,517 A 2/1999 Lisbon
5,918,744 A 7/1999 Bringard et al.
5,934,474 A 8/1999 Renninger et al.
5,992,630 A 11/1999 Brown et al.
6,050,410 A 4/2000 Quirion
6,070,726 A 6/2000 Graham
6,112,672 A 9/2000 Heil
6,149,009 A 11/2000 DeNola
6,196,449 B1 3/2001 Chen
6,309,334 B1 10/2001 Xapelli
6,669,082 B1 12/2003 Meyer
6,722,500 B2 4/2004 Deiger
6,769,548 B2 8/2004 Morell et al.
6,814,232 B1 11/2004 Morris et al.
6,880,313 B1 4/2005 Gessford et al.
6,886,692 B2 5/2005 Allison
6,896,175 B2 * 5/2005 Duke ..... B65D 5/48038 229/120.36
6,938,396 B2 9/2005 Okamoto
7,080,735 B2 7/2006 Allison
7,419,055 B2 9/2008 Manuel
7,455,214 B2 11/2008 Miller et al.
7,533,771 B2 5/2009 Allison
7,665,280 B2 2/2010 Youell, Jr. et al.
7,681,735 B2 3/2010 Youell, Jr.
7,775,419 B2 8/2010 Bale
8,474,686 B2 7/2013 Glaser et al.
9,096,349 B2 8/2015 Youell et al.
9,758,273 B2 9/2017 Youell et al.
9,878,817 B2 1/2018 Youell et al.
2003/0222129 A1 * 12/2003 Williams ..... B65D 5/48004 229/120.31
2005/0023281 A1 2/2005 Bradford
2009/0272792 A1 11/2009 Yang et al.
2012/0223129 A1 9/2012 Oppenheimer
2015/0336707 A1 * 11/2015 Youell ..... B65D 5/48038 493/391
2016/0185483 A1 6/2016 Youell et al.
2017/0369200 A1 12/2017 Youell et al.
2018/0079548 A1 3/2018 Youell et al.
2019/0315513 A1 * 10/2019 Hengami ..... B65D 5/0227

* cited by examiner

PARTITIONED CONTAINER

CROSS-REFERENCE TO RELATED APPLICATIONS

This application is a continuation-in-part application of U.S. application Ser. No. 17/208,650, filed on Mar. 22, 2021. The content of that application is incorporated by reference as if fully recited herein.

TECHNICAL FIELD

Exemplary embodiments of the present invention relate to a partitioned container for use with storage or transportation of various objects.

BACKGROUND AND SUMMARY

The present disclosure relates generally to containers, and more particularly to divided containers for use with object storage or shipping, such as for use in palletized shipping systems. Traditional divider systems are primarily configured for providing internal dividers within the box containing perimeter. The dividers may be formed of interlocking sheets. The interlocking sheets commonly comprise interior divided cells, and perimeter cells that are open around the perimeter of the divider. Alternatively, interlocking divider partitions do not delineate a complete perimeter cell, but provide for an abbreviated perimeter cell that functions as an air cell around the perimeter of the divider.

The use of perimeter cells results in a waste of a significant portion of the box container volume, and adds weight to the divider system that does not provide for additional item cells. In addition, heavy items carried in the interior cells may shift and collapse the perimeter air cells, allowing additional shifting of the contents of the box container. Shifting can cause impact damage or lead to the collapse of a stack of divider sections or box containers. Furthermore, the traditional divided container having exterior panels surmounting the interior divided cells cannot be folded about fold lines to a substantially flat state.

Certain issues with traditional divider systems have been previously addressed by introducing a crate formed from mated slotted transverse panels and slotted longitudinal panels, where said transverse panels and longitudinal panels (collectively or independently "interior panels") are surmounted by exterior panels, as disclosed in U.S. Pat. No. 9,096,349 B2 (the "349" patent) and other related patent applications. In the prior devices according to the '349 patent and other related patent applications (disclosed technology referred to herein as "prior assemblies"), folding tab sections of the transverse and longitudinal panels may be "facially affixed" to the exterior panels (the folding tab section extends horizontally along a portion of an exterior panel for substantially the distance from a fold line of the folding tab section to a side edge of the folding tab section opposite of the fold line, and the folding tab section is substantially affixed to the exterior panel for the distance thereof by adhesive or the like, thus eliminating perimeter cells. Additionally, fold lines of the interior and exterior panels permit the assembly to be folded into a substantially flat state.

However, because the folding tab sections of the prior assemblies may be facially affixed to the exterior panel(s), the interior panels must be sufficiently spaced apart to permit the folding tab sections to be facially affixed to an adjacent portion of the exterior panel(s). In the manufacturing process, it is difficult to facially affix narrower folding tab sections, such as folding tab sections less than 1 inch wide from side edge to fold line, to their respective exterior panel(s). Thus, it is not desirable to reduce the width of folding tab sections to reduce spacing between interior panels. Therefore, cell size may be limited to a large minimum volume in the prior assemblies. This may be an issue for the storage or transportation of smaller objects, which may suffer impact damage as they collide with one another if not sufficiently cushioned and isolated from one another by paperboard or other material defining the perimeter of a divider cell.

In addition, the '349 patent and other related patent applications may teach folding tab sections of substantially the same height (where height is defined as distance from the top edge to the bottom edge of the panel) or greater height than the rest of the interior panel. Also, with the prior assemblies, all or a substantial portion of interior panels may necessarily include folding tab sections. There may be certain issues with having folding tab sections of substantially the same height or greater height than the rest of the interior panel, and with having all or a substantial portion of interior panels necessarily including folding tab sections. One issue is that more material, labor and energy may be required to manufacture the folding tab sections, thus the overall monetary, labor and environmental costs of manufacturing the container may be higher. In addition, the higher amount of interior panel material may increase the weight of the container. Furthermore, the prior assemblies, when folded into a substantially flat state, may define a larger amount of space, since a higher volume of interior panel material may be positioned within the exterior panels.

The prior assemblies may further teach longitudinal panels having slots extending from a midpoint to one of a top or bottom edge of each longitudinal panel, and transverse panels having slots extending from a midpoint to the other of a top or bottom edge of each transverse panel for interlocking of the transverse panels with the longitudinal panels. An issue with the aforementioned configuration is that the crate formed from mated slotted transverse panels and slotted longitudinal panels may only be secured within the exterior panels by the introduction of a substantial amount of adhesive, including by way of example and not limitation, glue, staples, tape or the like, to interior panel folding tab sections to connect each interior panel to the exterior panel(s). For example, with the prior assemblies, adhesive may be applied to substantially all of the surface of each folding tab section facing the exterior panel(s) to facially affix the folding tab section thereto. Thus, more material, labor and energy may be required to secure the crate within the exterior panel(s), thus the overall monetary, labor and environmental costs of manufacturing may be higher. In addition, the higher amount of adhesive material or the like may increase the weight of the container.

In view of the foregoing, alternatives to traditional interlocking divider systems known in the art and to the prior assemblies are needed to improve efficiency in the shipping and manufacturing industries.

It is an exemplary objective of the present invention to provide a partitioned container comprising a plurality of individual compartments or cells formed by the interlocking of a first series of substantially parallel interior panels with a second series of substantially parallel interior panels, wherein the interlocked interior panels are positioned within one or more exterior panels. The present invention requires less material than traditional systems for manufacturing a specific sized container because the wasted space of perimeter cells is eliminated. Additionally, the foldability of the present design minimizes the amount of storage space needed for storing the exemplary container because the container, when folded, is in a substantially flat state.

It is another exemplary objective of the present invention to provide a cost-effective alternative to the prior assemblies, where the cost-effective alternative provides several dimensional advantages and includes a crate self-locking mechanism.

In exemplary embodiments, a plurality of interior panels comprise a partitioning section without any folding tab sections connected thereto. An advantage of not having any folding tab sections connected to the partitioning section of the interior panel is that the interior panel may be positioned any number of distances from adjacent interior panels without positioning being restricted by a requirement to facially affix a folding tab section to at least one exterior panel. For example, by way of illustration and not limitation, two parallel transverse panels, each not including any folding tab sections, may be placed in close proximity to one another to reduce cell size to provide for storage or transportation of smaller objects, where reduced cell size may prevent impact damage by sufficiently cushioning and isolating the smaller objects from one another, such as by paperboard or other material defining the perimeter of the cell. Another advantage of not having any folding tab sections connected to the partitioning section of the interior panel is that less material, labor and energy may be required to manufacture the folding tab sections, thus the overall costs, including but not necessarily limited to monetary, labor and environmental costs of manufacturing the container may be lower than that of prior assemblies. Yet another advantage of not having any folding tab sections connected to the partitioning section of each interior panel is that a smaller volume of interior panel material may be occupied between the one or more exterior panels, thus, for example, when an exemplary container is folded into a substantially flat state, the volume of space occupied by the container may be smaller. Still another advantage of not having any folding tab sections connected to the partitioning section of each interior panel is that the weight of the container may be reduced by having less folding tab section material therein.

In exemplary embodiments, each folding tab section is of a smaller height than the partitioning section linked thereto. An advantage of having each folding tab section being of smaller height than the partitioning section linked thereto is that less material, labor and energy may be required to manufacture the folding tab sections, thus the overall costs, including but not necessarily limited to monetary, labor and environmental costs of manufacturing may be reduced with respect to prior assemblies. Yet another advantage of each folding tab section being of a smaller height than the partitioning section linked thereto is that a smaller volume of interior panel material may be occupied between the one or more exterior panels, thus, for example, when an exemplary container is folded into a substantially flat state, the volume of space occupied by the container may be smaller. Yet another advantage of each folding tab section being of a smaller height than the partitioning section linked thereto is that one or more handles, each handle defined by an open gap in the one or more exterior panels, may be placed on a portion of the one or more exterior panels above or below a folding tab section. Still another advantage of each folding tab section being of a smaller height than the partitioning section linked thereto is that the weight of the container may be reduced by having less folding tab section material therein.

In exemplary embodiments, a first series of substantially parallel interior panels includes two outer panels having a first slot configuration, and a plurality of inner panels having a second slot configuration, wherein the plurality of inner panels are positioned between the two outer panels. In addition, in exemplary embodiments, a second series of substantially parallel interior panels includes two outer panels having a first slot configuration, and a plurality of inner panels having a second slot configuration, wherein the plurality of inner panels are positioned between the two outer panels, and wherein the second series of substantially parallel interior panels intersects the first series of substantially parallel interior panels. Each interior panel may be necessarily contained within one or more exterior panels by the interlocking of the interior panel with other interior panels configured to receive the interior panel at both of at least one slot beginning at a top edge of the interior panel, and at least one slot beginning at a bottom edge of the interior panel. Exemplary slot configurations of the interior panels cause respective mated panels to be vertically and horizontally secured to one another ("self-locking mechanism") while also having the ability to be rotated with respect to one another. Thus, the need to have the surface of at least one folding tab section of each interior panel facing the exterior panel(s) facially affixed thereto by large amounts of adhesive or the like to prevent the interior panels from sliding or falling out of the crate within the exterior panel(s) has been reduced or eliminated. Thus, less material, labor and energy may be required to secure the crate within the exterior panel(s), thus the overall costs, including but not necessarily limited to monetary, labor and environmental costs of manufacturing may be reduced with respect to prior assemblies. Another advantage of an exemplary self-locking mechanism is that the weight of the container may be reduced by having less adhesive material therein.

According to one exemplary embodiment of the present invention, the partitioned container may include one or more exterior panels, and a series of substantially parallel transverse panels. Each transverse panel may include a top edge, a bottom edge, and a pair of side edges. Each transverse panel may further include a partitioning section. The partitioning section of the transverse panel may have at least one slot extending upwardly from the bottom edge of the transverse panel, and at least one slot extending downwardly from the top edge of the transverse panel. The one or more slots may be wider near the edge to improve the rotatability of the transverse panel with respect to a longitudinal panel, and/or to reduce the overall weight of the transverse panel. The transverse panels adjacent to substantially parallel exterior panel walls ("outer transverse panels") may comprise a first slot configuration, and transverse panels positioned between the outer transverse panels ("inner transverse panels") may comprise a second slot configuration, wherein the second slot configuration may substantially resemble a 180-degree vertical rotation of the first slot configuration.

The exemplary partitioned container may additionally include a series of substantially parallel longitudinal panels. Each longitudinal panel may include a top edge, a bottom edge, and a pair of side edges. Each longitudinal panel may further include a partitioning section and two folding tab sections, wherein the folding tab sections may extend from each side of the partitioning section, and wherein the folding tab sections may each extend only a fraction of the height of the partitioning section. The partitioning section of each longitudinal panel may have at least one slot extending downwardly from the top edge of the longitudinal panel, and at least one slot extending upwardly from the bottom edge of the longitudinal panel. Each slot may be wider near the edge to improve the rotatability of the longitudinal panel with respect to the transverse panel, and/or to reduce the overall weight of the longitudinal panel. The longitudinal panels adjacent to substantially parallel exterior panel walls ("outer longitudinal panels") may comprise a first slot configuration, and longitudinal panels positioned between the outer longitudinal panels ("inner longitudinal panels") may comprise a second slot configuration, wherein the second slot configuration may substantially resemble a 180-degree vertical rotation of the first slot configuration.

The longitudinal panels may be substantially perpendicularly disposed with the transverse panels, where transverse panel slots may be placed within longitudinal panel slots to create a crate of individual compartments or cells. The crate and each interior panel member thereof may be vertically and horizontally bound within the one or more exterior panels based on a self-locking mechanism of the interior panels, wherein the self-locking mechanism does not restrict the ability of interior panels to be rotated with respect to one another and the one or more exterior panels.

Each of at least one exterior panel may have a top edge, a bottom edge, and a pair of side edges. The at least one exterior panel may have a plurality of vertical fold lines. In some embodiments, the at least one exterior panel may have tabs at one edge and mating recesses corresponding to the tabs on the opposite edge. In other embodiments, the at least one exterior panel may have one or more tabs on one side edge that overlap a portion of the opposite edge when such an exterior panel is mated with a corresponding exterior panel. The at least one exterior panel may surmount the crate for forming an outside of the partitioned container. Each longitudinal panel folding tab section may be joined to the exterior panel(s). The resulting partitioned container may be folded about the various fold lines of the exterior and interior panels such as to a substantially flat state.

BRIEF DESCRIPTION OF THE DRAWINGS

In addition to the features and advantages mentioned above, other features and advantages disclosed herein will become more apparent from the following detailed description of exemplary embodiments when read in conjunction with the attached drawings, wherein like reference numerals across the several views refer to identical or equivalent features, and wherein.

DETAILED DESCRIPTION

The disclosed partitioned container is useful in shipping various objects, for example individual component parts for automobiles, in individual compartments so as to prevent damage to the various objects or component parts, for example by parts bumping against each other during shipment. The disclosed partitioned container may be shipped or stored in a relatively flat, folded down configuration and then unfolded for insertion of various objects or component parts. The entire volume of the partitioned container may be used for storing objects or component parts inasmuch as individual compartments fill the entire interior volume of the partitioned container. The disclosed partitioned container assembly may contain a plurality of fold lines and folding tab sections that permit folding of the assembly. Excluding folding tab sections from certain interior panels may permit certain parallel panels to be placed in close proximity to one another to define small compartments protecting small component parts or objects from colliding with one another. Excluding folding tab sections from certain interior panels, and reducing folding tab section height with respect to the connected partitioning section may decrease manufacturing costs and container weight. Alternating slot placement on interior panels may provide for a self-locking mechanism thereof.

Figure 1:
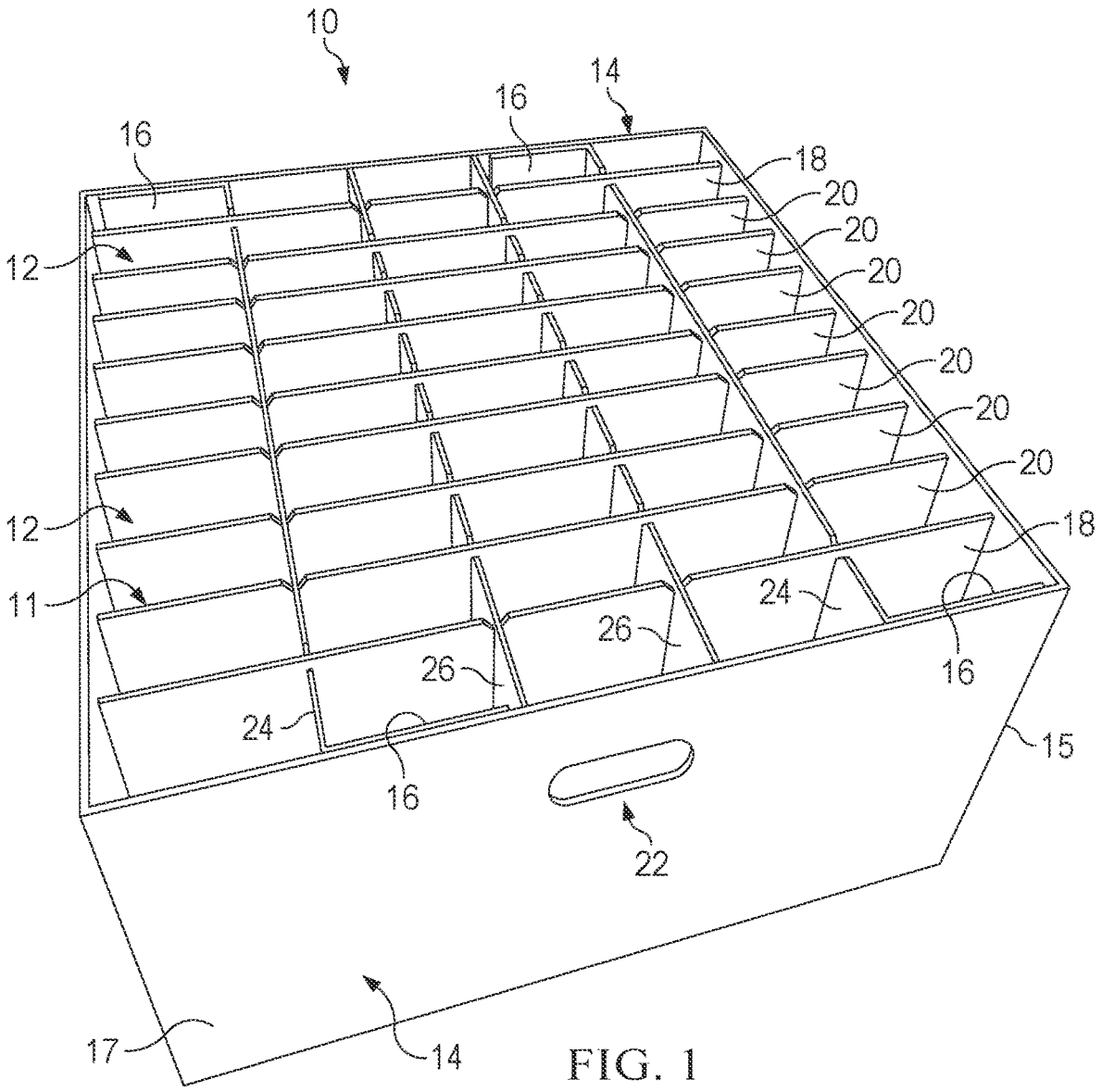
FIG. 1 is a perspective view of an exemplary partitioned container.

Referring initially to FIG. 1, an exemplary partitioned container 10 is shown in an open position, wherein objects (not shown) may be introduced to or removed from various compartments 12. The partitioned container 10 may comprise a crate 11 having a plurality of individual cells or compartments 12 for stuffing with the same or different objects or component parts for storage or shipment. The partitioned container 10 may be useful for shipping small automobile parts, although such use is not required. Such number of individual compartments 12 is by way of illustration and not limitation.

The crate 11 of the partitioned container 10 may comprise a plurality of interior panels. As shown in FIG. 1, interior panels may include one or more longitudinal panels 24, 26 and transverse panels 18, 20, wherein the longitudinal panels 24, 26 and transverse panels 18, 20 may interlock to define the perimeter of the compartments 12 of the crate 11, as described below. The transverse panels 18, 20 and longitudinal panels 24, 26 may be surmounted by one or more exterior panels 14 having walls 17, the walls 17 being foldable about exterior panel fold lines 15. In the particular embodiment shown, longitudinal panels 24, 26 include inner longitudinal panels 26 and outer longitudinal panels 24. The inner longitudinal panels 26 may be positioned between the outer longitudinal panels 24, where the outer longitudinal panels 24 may be positioned adjacent to substantially parallel exterior panel walls 17. The longitudinal panels 24, 26 may include one or more folding tab sections 16, wherein each folding tab section 16 may be facially affixed to an inner portion of the exterior panel 14. Furthermore, in the particular embodiment shown, transverse panels 18, 20 include inner transverse panels 20 and outer transverse panels 18. The inner transverse panels 20 may be positioned between outer transverse panels 18, where the outer transverse panels 18 may be positioned adjacent to substantially parallel exterior panel walls 17. A handle 22 defined by a gap in the exterior panel 14 may be positioned at a portion of the exterior panel 14 not having a folding tab section 16 facially affixed thereto. One or more handles 22 of an exemplary container 10 may be useful, for example, for carrying a container 10 from one location to any number of other locations.

Referring now to FIGS. 1-6, a series of longitudinal panels, indicated generally at 24 (FIG. 2) and 26 (FIG. 3), may be mated with a series of transverse panels, indicated generally at 18 (FIG. 4) and 20 (FIG. 5), to form a crate 11 of exemplary individual compartments 12 in the interior of the partitioned container 10. In the embodiments shown, a series of transverse panel slots, such as indicated at 56 (FIGS. 4-5), may be configured to cooperate for mutual insertion with a series of longitudinal panel slots, such as indicated at 30 (FIGS. 2-3), when the slots are placed at substantially right angles to one another to form a crate 11 of exemplary individual compartments 12 in the interior of the partitioned container 10.

Figure 2:
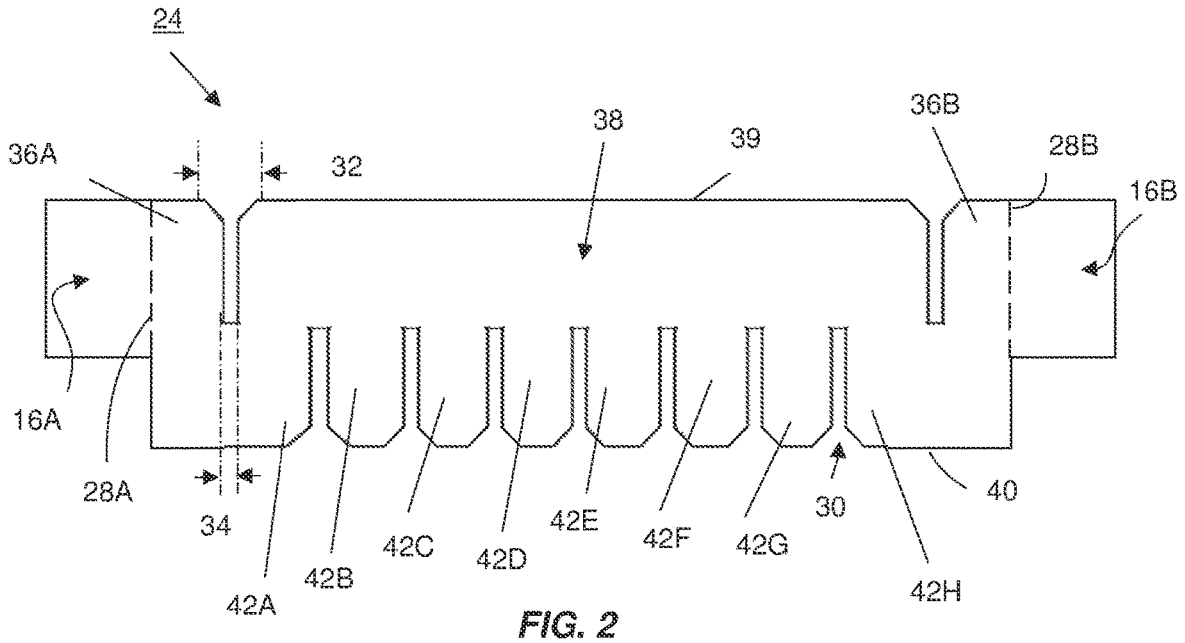
FIG. 2 is a plan view of an outer longitudinal panel according to an exemplary embodiment of the invention.

Referring specifically to FIG. 2, an outer longitudinal panel 24 may include a partitioning section 38 extending from a top edge 39 of the panel 24 to a bottom edge 40 of the panel 24, and extending from fold line 28A to fold line 28B, wherein fold lines 28A and 28B each define a portion of each side edge of the partitioning section 38. A folding tab section 16A-B may extend from each fold line 28A-B away from the partitioning section 38. The folding tab sections 16A-B may each substantially extend from the top edge 39 to a mid-portion height of the panel 24 between the top edge 39 and the bottom edge 40. The decreased height of the folding tab sections 16A-B with respect to the partitioning section 38 may provide the advantage of having less material within the container 10, thus reducing the weight of the container 10, the volume of the container 10 when the container 10 is folded to a substantially flat state, and the costs of manufacturing the container 10. For example, by way of illustration and not limitation, less adhesive may be needed to facially affix a folding tab section to an exterior panel when the height of the folding tab section has been reduced.

The fold lines 28A-B may run along the edges shared by the partitioning section 38 and the folding tab sections 16A-B, forming inner side edges of the folding tab sections 16A-B, respectively. The partitioning section 38 may further comprise a series of slots 30 separating upper panel tabs 36A-B and lower panel tabs 42A-H from one another. In the embodiment shown, certain slots 30 extend downwardly from the top edge 39 of the panel 24 to about a midpoint of the height thereof to separate each upper panel tab 36A-B from the remainder of the partitioning section 38, and other slots extend upwardly from the bottom edge 40 of the panel 24 to about a midpoint of the height thereof to separate each lower panel tab 42A-H from one another.

Figure 3:
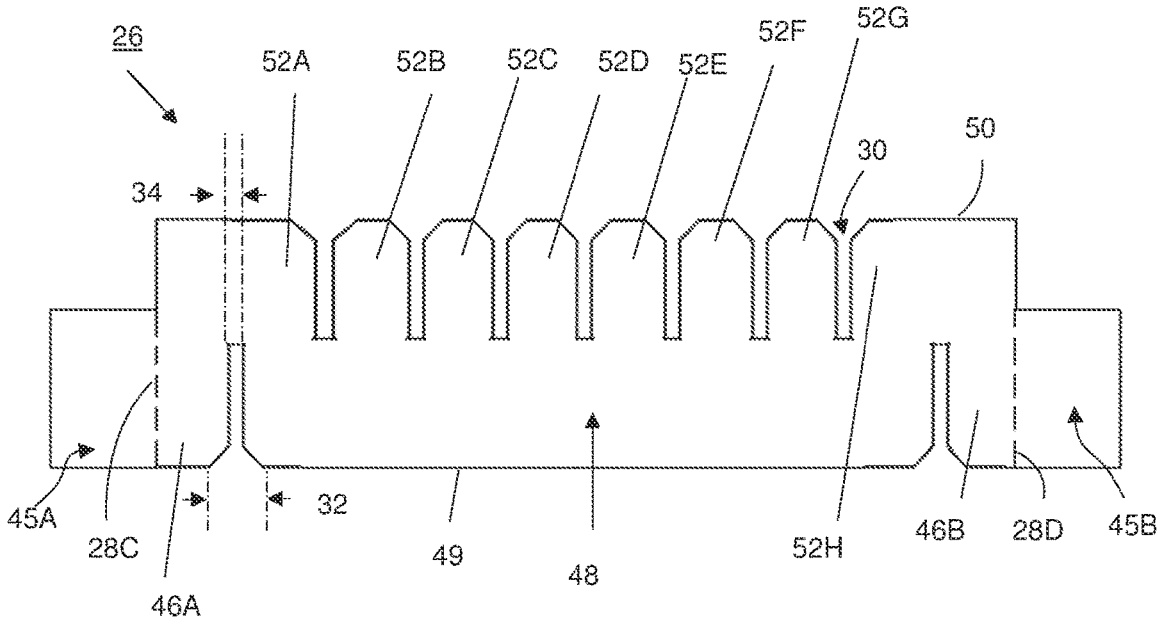
FIG. 3 is a plan view of an inner longitudinal panel according to an exemplary embodiment of the invention.

Referring specifically to FIGS. 1-3, the folding tab section (16A-B, 45A-B) may cause the partitioning section (38, 48) connected thereto to be horizontally and vertically secure with respect to an adjacent exterior panel wall 17, and to be in rotational communication with the same. In some embodiments, folding tab sections 16A-B, 45A-B are facially affixed to an inner portion of the at least one exterior panel 14 by an amount of adhesive, including by way of example and not limitation, glue, staples, tape, or the like. One folding tab section (e.g., 16A in FIG. 2) of a panel (e.g., 24 in FIGS. 1-2) may extend horizontally along a portion of the exterior panel(s) 14 in a first direction from the partitioning section (e.g., 38 in FIG. 2), and the other folding tab section (e.g., 16B in FIG. 2) of the panel (e.g., 24 in FIG. 1-2) may extend horizontally along a portion of the exterior panel(s) 14 in a second direction from the partitioning section (e.g., 38 in FIG. 2) substantially opposite of the first direction. In the FIGS. 1-3 embodiments, longitudinal panels 24, 26 may be folded about fold lines 28 to permit compaction of the crate 11 within the container 10, wherein the volume of space surrounded by each compartment 12 is substantially reduced or eliminated as the container 10 is folded towards a substantially flat state.

Referring to FIGS. 2-5, each panel tab (e.g., 36A-B, 42A-H in FIG. 2) may comprise non-right-angle corners along the edge (e.g., 39, 40 in FIG. 2), such that, for example, each slot 30, 56 may comprise a narrow gap 34, 58 and wide gap 32, 60. Narrow gaps 34, 58 may function to receive, and vertically and horizontally secure the partitioning section 38, 48, 62, 74 of a mated interior panel, and wide gaps 32, 60 may facilitate the rotation of the mated interior panel by reducing friction between the panels by reducing the contact area between the slot 30, 56 of one panel and the partitioning section 38, 48, 62, 74 of the other panel. Additionally, this particular configuration may reduce the overall weight of each interior panel by reducing the relative surface area of each panel tab (e.g., 42A-H in FIG. 2) with respect to empty space defined by each slot 30, 56.

Referring specifically to FIG. 3, an inner longitudinal panel 26 may include a partitioning section 48 extending from a top edge 50 of the panel 26 to a bottom edge 49 of the panel 26, and extending from fold line 28C to fold line 28D, wherein fold lines 28C and 28D each define a portion of each side edge of the partitioning section 48. A folding tab section 45A-B may extend from each fold line 28C-D away from the partitioning section 48. The folding tab sections 45A-B may each substantially extend from the bottom edge 49 to a mid-portion height of the panel 26 between the top edge 50 and the bottom edge 49. The decreased height of the folding tab sections 45A-B with respect to the partitioning section 48 may provide the advantage of having less material within the container 10, thus reducing the weight of the container 10, the volume of the container 10 when the container 10 is folded to a substantially flat state, and the costs of manufacturing the container 10. For example, by way of illustration and not limitation, less adhesive may be needed to facially affix a folding tab section to an exterior panel when the height of the folding tab section has been reduced.

The fold lines 28C-D may run along the edges shared by the partitioning section 48 and the folding tab sections 45A-B, forming inner side edges of the folding tab sections 45A-B, respectively. The partitioning section 48 may further comprise a series of slots 30 separating lower panel tabs 46A-B and upper panel tabs 52A-H from one another. In the embodiment shown, certain slots 30 extend upwardly from the bottom edge 49 of the panel 26 to about a midpoint of the height thereof to separate each lower panel tab 46A-B from the remainder of the partitioning section 48, and other slots extend downwardly from the top edge 50 of the panel 26 to about a midpoint of the height thereof to separate each upper panel tab 52A-H from one another.

Figure 4:
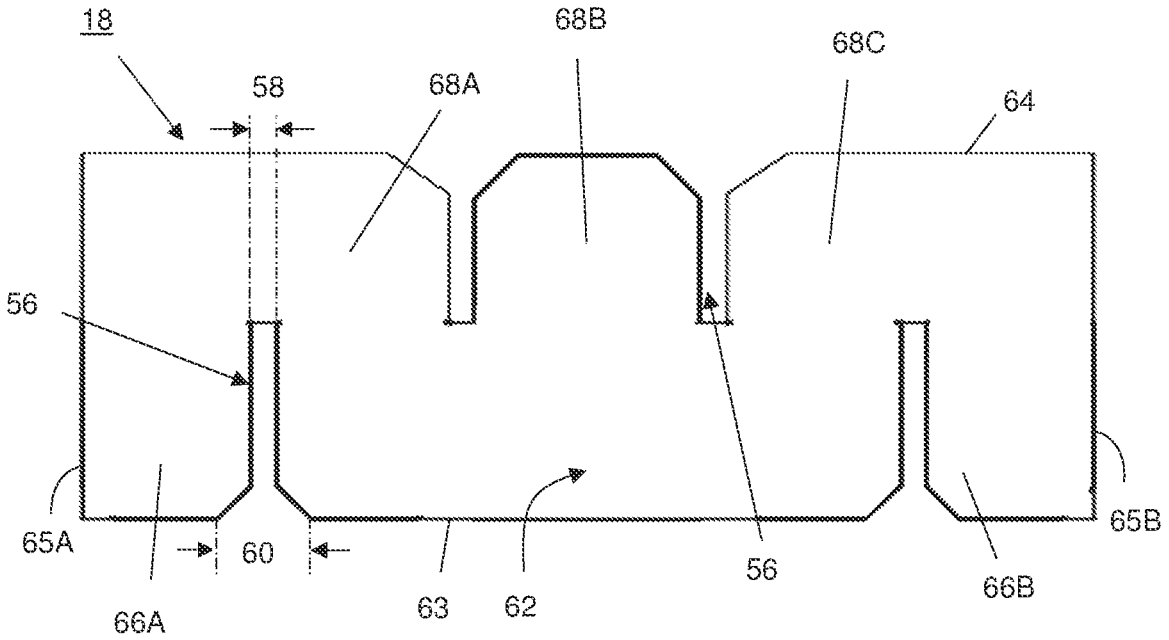
FIG. 4 is a plan view of an outer transverse panel according to an exemplary embodiment of the invention.

Referring now to FIG. 4, an outer transverse panel 18 may include a partitioning section 62 extending from a top edge 64 of the panel 18 to a bottom edge 63 of the panel 18, and extending from side edge 65A to side edge 65B of the panel 18. In the embodiment shown, the outer transverse panel 18 does not include any folding tab sections. This particular configuration may provide the advantage of having less material within the container 10, thus reducing the weight of the container 10, the volume of the container 10 when the container 10 is folded to a substantially flat state, and the costs of manufacturing the container 10. For example, by way of illustration and not limitation, less adhesive may be needed to facially affix folding tab sections to one or more exterior panels when less folding tab sections are present in the container. This particular configuration may further provide the advantage of allowing transverse panels to be placed in closer proximity to one another without folding tab section obstructing placement thereof.

The partitioning section 62 may further comprise a series of slots 56 separating upper panel tabs 68A-C and lower panel tabs 66A-B from one another. In the embodiment shown, certain slots 56 extend downwardly from the top edge 64 of the panel 18 to about a midpoint of the height thereof to separate each upper panel tab 68A-C from one another, and other slots extend upwardly from the bottom edge 63 of the panel 18 to about a midpoint of the height thereof to separate each lower panel tab 66A-B from the remainder of the partitioning section 62.

Figure 5:
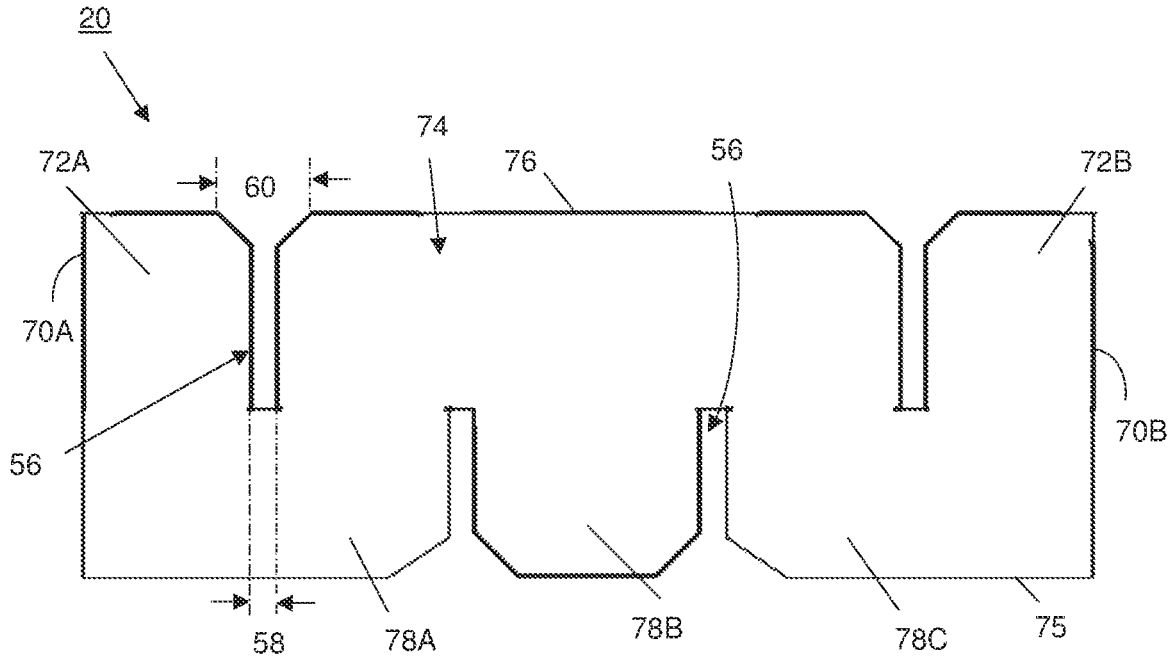
FIG. 5 is a plan view of an inner transverse panel according to another exemplary embodiment of the invention.

Referring now to FIG. 5, an inner transverse panel 20 may include a partitioning section 74 extending from a top edge 76 of the panel 20 to a bottom edge 75 of the panel 20, and extending from side edge 70A to side edge 70B of the panel 20. In the embodiment shown, the inner transverse panel 20 does not include any folding tab sections. This particular configuration may provide the advantage of having less material within the container 10, thus reducing the weight of the container 10, the volume of the container 10 when the container 10 is folded to a substantially flat state, and the costs of manufacturing the container 10. For example, by way of illustration and not limitation, less adhesive may be needed to facially affix folding tab sections to one or more exterior panels when less folding tab sections are present in the container. This particular configuration may further provide the advantage of allowing transverse panels to be placed in closer proximity to one another without folding tab sections obstructing placement thereof.

The partitioning section 74 may further comprise a series of slots 56 separating lower panel tabs 78A-C and upper panel tabs 72A-B from one another. In the embodiment shown, certain slots 56 extend upwardly from the bottom edge 75 of the panel 20 to about a midpoint of the height thereof to separate each lower panel tab 78A-C from one another, and other slots extend downwardly from the top edge 76 of the panel 20 to about a midpoint of the height thereof to separate each upper panel tab 72A-B from the remainder of the partitioning section 74.

Referring now to FIGS. 1-6, each slot 30 extending downward from the top edge 39 of an outer longitudinal panel 24 may be configured to mate with a slot 56 extending upward from the bottom edge 63 of an outer transverse panel 18. Mating thereof may cause the outer transverse panel 18 to be bound from below the slot 56 by the partitioning section 38 of the outer longitudinal panel 24, and the outer longitudinal panel 24 to be bound from above the slot 30 by the partitioning section 62 of the outer transverse panel 18. Each slot 30 extending upward from the bottom edge 40 of an outer longitudinal panel 24 may be configured to mate with a slot 56 extending downward from the top edge 76 of an inner transverse panel 20. Mating thereof may cause the inner transverse panel 20 to be bound from above the slot 56 by the partitioning section 38 of the outer longitudinal panel 24, and the outer longitudinal panel 24 to be bound from below the slot 30 by the partitioning section 74 of the inner transverse panel 20.

Each slot 30 extending downward from the top edge 50 of an inner longitudinal panel 26 may be configured to mate with a slot 56 extending upward from the bottom edge 75 of an inner transverse panel 20. Mating thereof may cause the inner transverse panel 20 to be bound from below the slot 56 by the partitioning section 48 of the inner longitudinal panel 26, and the inner longitudinal panel 26 to be bound from above the slot 30 by the partitioning section 74 of the inner transverse panel 20. Each slot 30 extending upward from the bottom edge 49 of an inner longitudinal panel 26 may be configured to mate with a slot 56 extending downward from the top edge 64 of an outer transverse panel 18. Mating thereof may cause the outer transverse panel 18 to be bound from above the slot 56 by the partitioning section 48 of the inner longitudinal panel 26, and the inner longitudinal panel 26 to be bound from below the slot 30 by the partitioning section 62 of the outer transverse panel 18.

The particular interior panel slot configurations of the FIGS. 1-6 embodiments may provide for a self-locking mechanism of the crate 11 of container 10, wherein each interior panel member (e.g., 18, 24) forming the crate 11 may be vertically and horizontally bound between the one or more exterior panels 14. Specifically, each interior panel (e.g., 18, 24) may be bound by partitioning sections (e.g., 38, 62) positioned above certain slots (30, 56) of the panel (e.g., 18, 24), and may further be bound by partitioning sections (e.g., 38, 62) positioned below certain slots (30, 56) of the panel (e.g., 18, 24) as described above. This particular configuration may prevent each interior panel, regardless of whether the interior panel comprises any folding tab sections facially affixed to at least one exterior panel or not, from falling out of the crate, sliding out of the crate, being pulled out of the crate, or the like. The self-locking mechanism of the FIGS. 1-6 embodiments reduces the need for adhesive to be used to maintain the crate 11 and interior panel members thereof within the one or more exterior panels 14. An advantage of reducing the need for adhesive to be used to maintain a crate and interior panel members thereof within one or more exterior panels of an exemplary container is that manufacturing costs and the overall weight of the container may be reduced by having less adhesive in the container.

Figure 6:
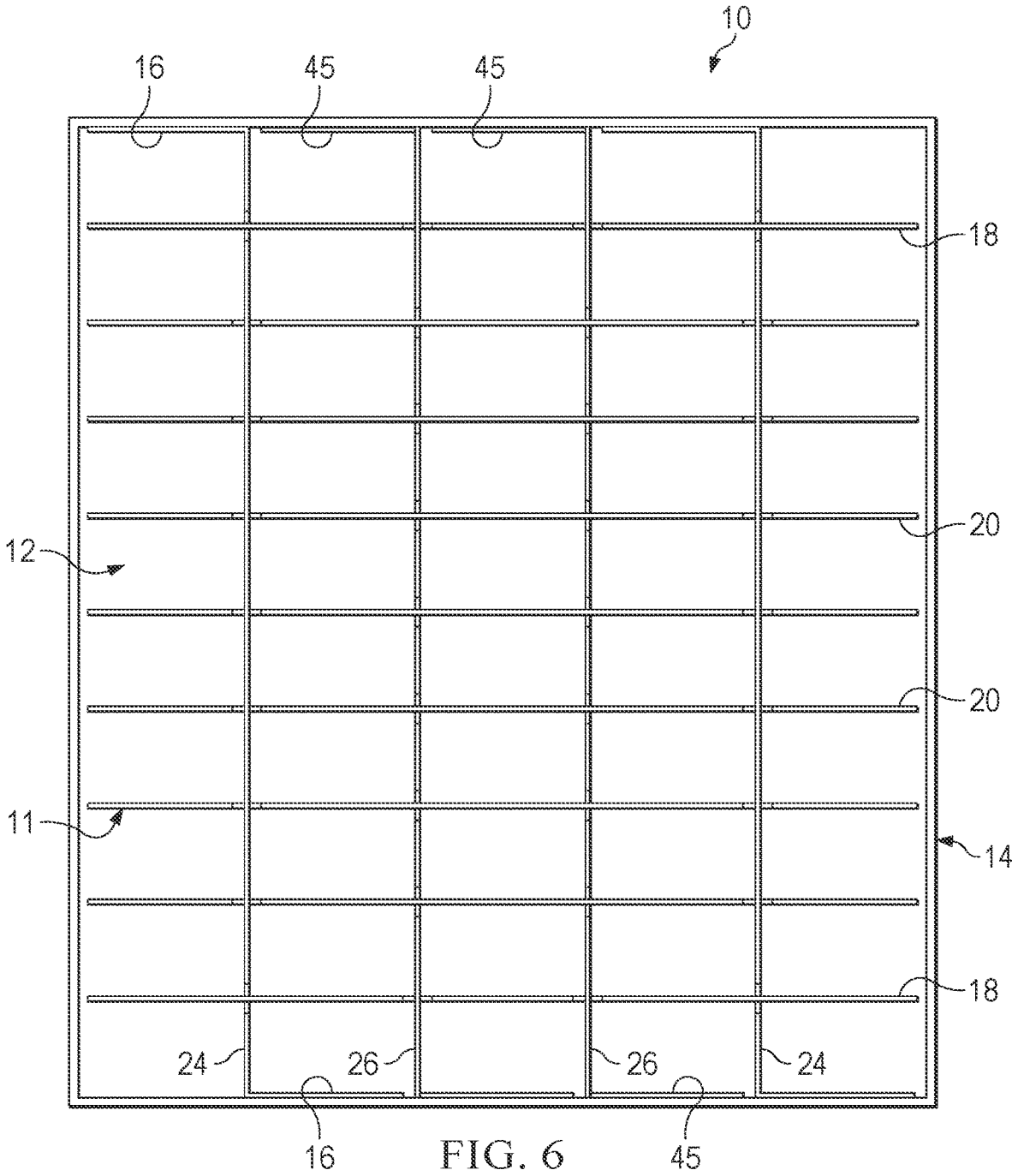
FIG. 6 is a top view of the exemplary partitioned container of the FIG. 1 embodiment.

FIG. 6 shows the placement of various folding tab sections 16, 45 in an exemplary container 10 comprising a crate 11 having a plurality of compartments 12. It is not intended that the present invention be limited to the folding tab section configurations shown and described in the present disclosure. In other exemplary embodiments, certain longitudinal panels may comprise less than two folding tab sections. In still other exemplary embodiments, certain transverse panels may comprise one or more folding tab sections. For example, by way of illustration and not limitation, in other embodiments, a folding tab section may be configured to extend through a gap between a free edge of an adjacent interior panel and an exterior panel, such that the folding tab section extends substantially across two individual compartments of the partitioned container.

Referring now to FIGS. 1 and 6-8, the exterior panel 14 having a plurality of walls 17 may further comprise a plurality of folding tab sections 82, each folding tab section 82 extending from a top and/or a bottom edge of each wall 17, wherein the folding tab sections may be folded about fold lines 84 at the top and/or bottom edge of each wall 17, such as to permit the container 10 to be folded to a substantially flat state. The walls 17 may be rotated with respect to one another about fold lines 15, such as to permit the container 10 to be folded (e.g., fold direction and movement demonstrated by arrow 88 in FIG. 8) to a substantially flat state. Additionally, the exterior panel folding tab sections 82 may be folded about the fold lines 84 and adhered to one another, such as with tape, staples, glue, or the like, or interlocked with one another to form a roof and/or a floor of the partitioned container 10, wherein the exterior panel folding tab sections 82 cover at least a portion of the crate 11 of compartments 12 formed by interior panels 18, 20, 24, 26 and exterior panel(s) 14. In the FIG. 7 embodiment, a floor of adhered or interlocked folding tab section 82 may define the base of the partitioned container 10.

Figure 7:
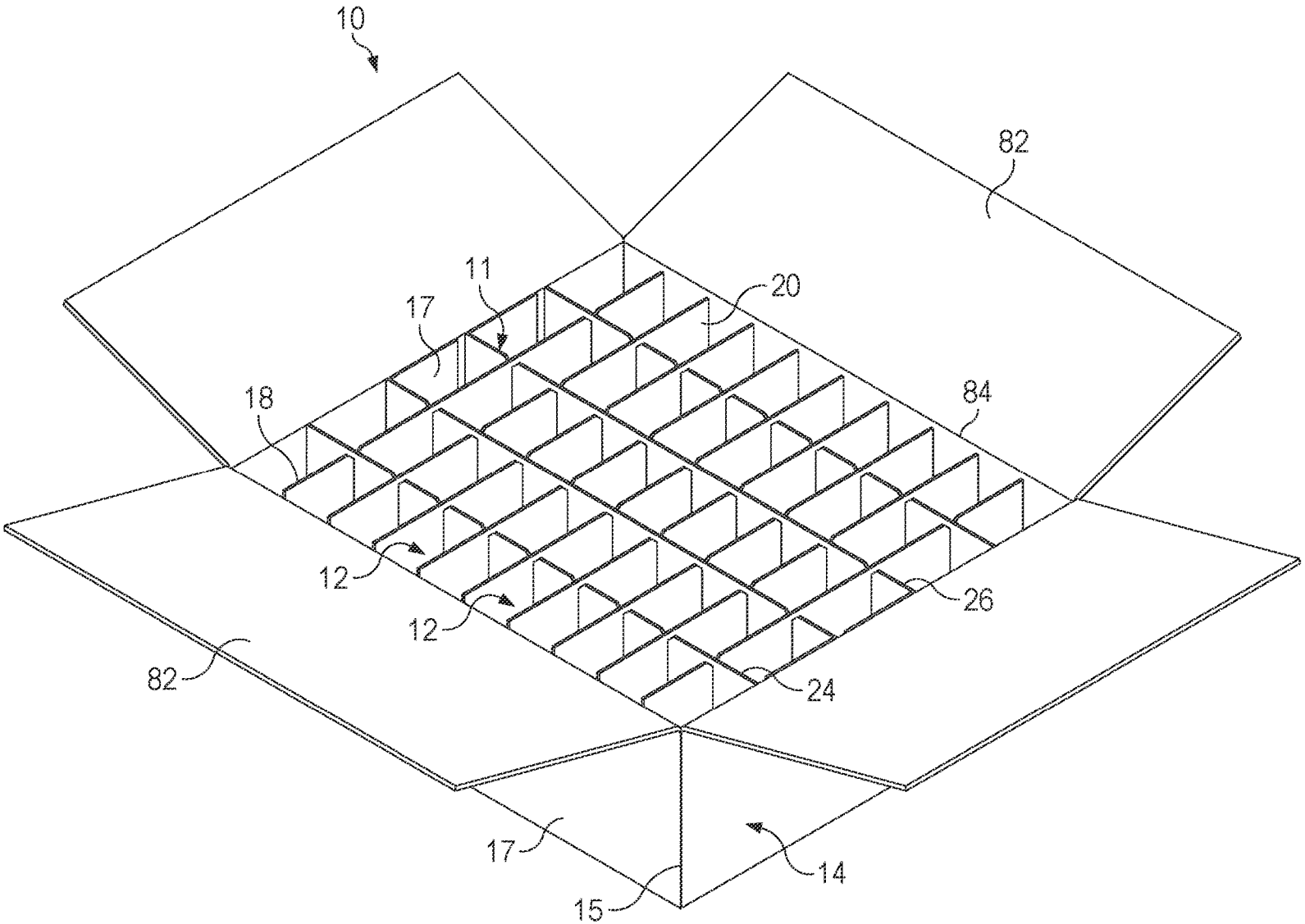
FIG. 7 is a bottom perspective view of the partitioned container of the FIG. 1 embodiment.
Figure 8:
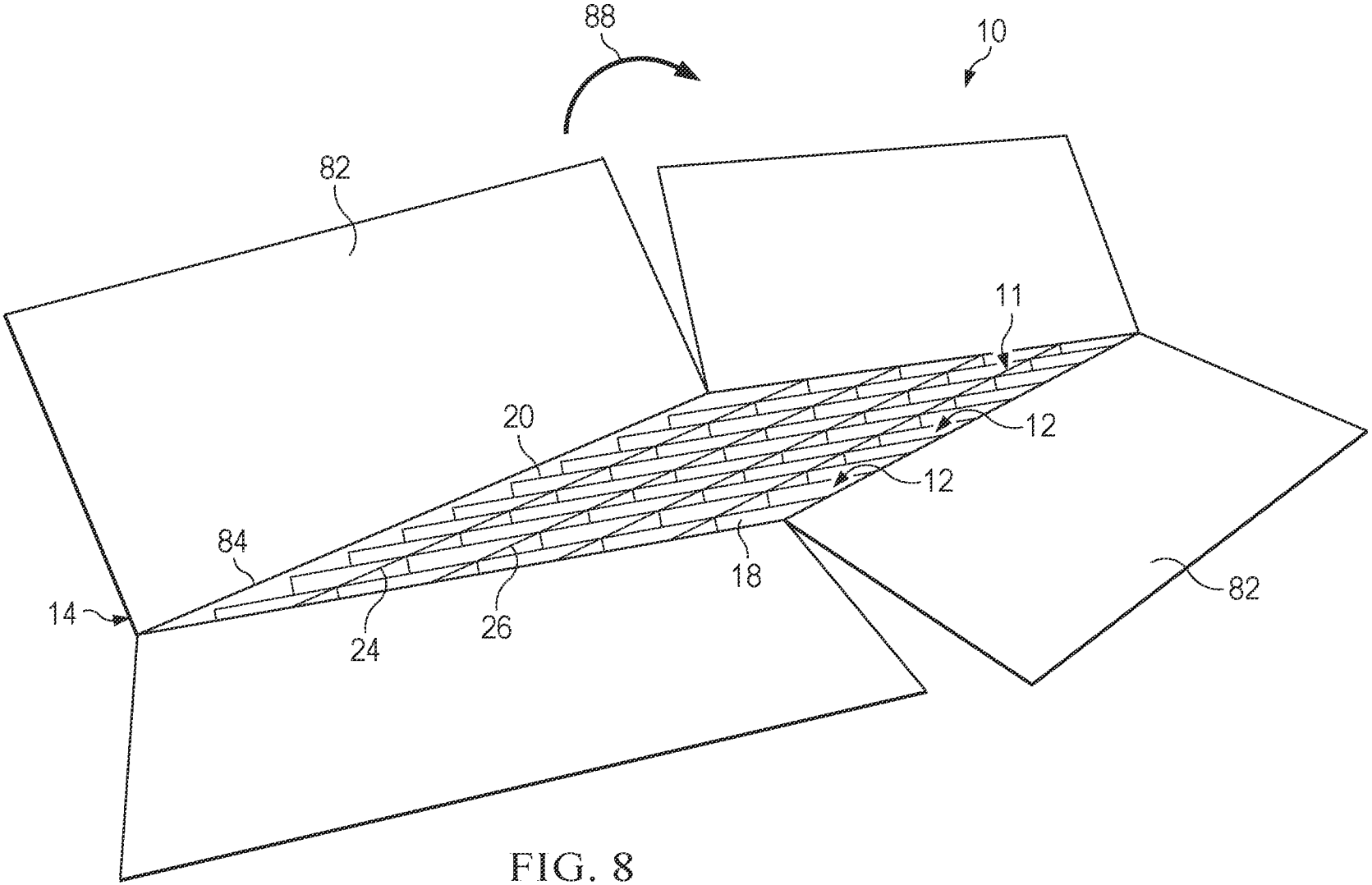
FIG. 8 is a bottom perspective view of the partitioned container of the FIG. 1 embodiment, wherein the partitioned container is being flattened towards a substantially flat state.

As is illustrated in FIG. 8, the exemplary partitioned container 10 of the FIG. 7 embodiment may be folded (fold direction demonstrated by arrow 88) into a substantially flat state. Force may be applied to one or more portions of a substantially empty partitioned container 10, such as, for example by way of illustration and not limitation, to a portion of the exterior panel 14, to cause the exterior panel 14 and interior panels (e.g., 24, 26) to rotate about respective fold lines until air volumes defining the interiors of each substantially empty compartment 12 have been substantially reduced or eliminated. Where certain interior panels (e.g., 18, 20) do not include any folding tab sections, rotation of the panels (e.g., 18, 20) may be caused by torque applied from other panels (e.g., 24, 26) mated therein and/or exterior panel(s) (e.g., 14) as the other panels (e.g., 24, 26) mated therein and/or exterior panels (e.g., 14) rotate.

The partitioned containers 10 may be folded substantially flat for storage and/or stacking, for example. Additionally, the partitioned containers 10 may be folded substantially flat for shipment, for example. The flattened configuration may reduce costs for users as a result of requiring less space while being transported or stored in an empty state. When it is desired that the partitioned container 10 in the substantially flat state is to have objects introduced to it, the process shown in FIG. 8 may be reversed until the configuration shown in FIG. 6, for example, is reached. The exterior panel folding tab sections 82 may be rotated about fold lines 84, and interlocked thereafter to define a roof or floor of the partitioned container 10, such as for purposes of storing or shipping objects. In other embodiments, the roof or floor of the partitioned container 10 may be a detachable lid, pallet surface, or the like. In yet other embodiments, the base of the partitioned container 10 may comprise a floor. It will be apparent to one of ordinary skill in the art that various surfaces and/or materials may be used to define the roof and/or base of an exemplary partitioned container.

In some embodiments, the at least one exterior panel 14 comprises one or more tabs at one edge and at least one mating recesses corresponding to the tab(s) on the opposite edge. The present invention is not intended to be limited to the use of a single exterior panel having a mating tab, however. In other embodiments, for example by way of illustration and not limitation, the at least one exterior panel may have one or more tabs on one side edge that overlap a portion of the opposite edge when such an exterior panel is mated with a corresponding exterior panel. Depending on the number of compartments desired, a plurality of exterior panels may be required to form the outside of the partitioned container. In such an embodiment, the number of fold lines will be adjusted accordingly. It will be apparent to those of ordinary skill in the art that there are various ways to surmount an exemplary crate of interior panels to define the outside of an exemplary partitioned container.

Materials of construction for forming certain exemplary partitioned containers may be paperboard or corrugated material, such as, for example, cardboard, pasteboard, fiberboard, corrugated plastic sheets, or the like. However, other recyclable material having the necessary strength and rigidity for the particular application envisioned may be suitable. It will be appreciated that component part construction thereof, i.e., single-ply, double-ply, or higher, may be varied depending upon the application. The partitioned containers are shown and described in particular reference to the use of corrugated paperboard; however, such description is illustrative and not a limitation on the present disclosure.

It is not intended that the present invention be limited to the embodiments described above. For example, by way of illustration and not limitation, adjustments in the location and/or arrangement of slots in each interior panel may be made without departing from the scope of the present invention. Furthermore, the number of slots in each interior panel may be varied depending on the number of interior partitions or individual compartments desired. Furthermore, the number of panels could be in greater or fewer number than that shown in the drawings. Thus, the number of individual compartments for exemplary partitioned containers is a matter of choice and may be fewer or greater than that shown in the drawings.

While the partitioned containers have been described with reference to various embodiments, those skilled in the art will understand that various changes may be made, and equivalents may be substituted for elements thereof without departing from the scope and essence of the disclosure. In addition, many modifications may be made to adapt a particular situation or material to the teachings of the disclosure without departing from the essential scope thereof. Therefore, it is intended that the partitioned container not be limited to the particular embodiments disclosed. All citations referenced herein are expressly incorporated herein by reference.

What is claimed is:

1. A partitioned container comprising:

one or more exterior panels defining an interior compartment;

a first number of interior partitions, each comprising:

a top edge and a bottom edge;

a pair of side edges;

a partitioning section comprising a top edge and a bottom edge, and a pair of side edges, and comprising a number of slots extending from both of said top and bottom edges to an intermediate height thereof;

wherein each of said partitioning sections extend alongside one another and substantially cross said interior compartment in a first direction;

a second number of interior partitions, each comprising:

a top edge and a bottom edge;

a pair of side edges;

a partitioning section, comprising a top edge and a bottom edge, and a pair of side edges, and comprising a number of slots extending from both of said top and bottom edges to an intermediate height thereof;

a pair of folding tab sections including a first folding tab section extending from a right-side edge of said partitioning section in a first direction, and configured for folding about a vertically extending fold line located at said right side edge, and a second folding tab section extending from a left-side edge of said partitioning section in a second direction opposing said first direction, and configured for folding about a vertically extending fold line located at said left-side edge;

wherein each of said partitioning sections extend alongside one another and substantially cross said interior compartment in a second direction intersecting said first direction;

wherein each of said folding tab sections are attached to one of said one or more exterior panels;

wherein each of said partitioning sections of each of said first number of interior partitions are mated with each of said partitioning sections of each of said second number of interior partitions by way of said slots in said partitioning sections of said first and second number of interior partitions to define a series of individual compartments within the interior compartment;

wherein vertical and horizontal movement with respect to said one or more exterior panels of each of said first number of interior partitions is restricted by said partitioning sections of said second number of interior partitions mated thereto;

wherein vertical and horizontal movement with respect to said one or more exterior panels of each of said second number of interior partitions is restricted by said partitioning sections of said first number of interior partitions mated thereto; and wherein said fold line of said first folding tab section extends a fraction of a height of said right side-edge, and a remainder of said right-side edge is an open edge, and said fold line of said second folding tab section extends a fraction of a height of said left-side edge, and a remainder of said left-side edge is an open edge.

2. The partitioned container of claim 1 further comprising:

a free edge at each side edge of said first number of interior partitions.

3. The partitioned container of claim 1, wherein:

said partitioned container comprises corrugated paperboard.

4. The partitioned container of claim 1, wherein:

said partitioned container is configured for folding about fold lines such that adjacent ones of said first number of interior partitions or second number of interior partitions are configured to selectively contact one another without any folding tab sections thereof becoming detached from said one or more exterior panels.

5. The partition container of claim 1, wherein:

said one or more exterior panels further comprise one or more exterior panel folding tab sections, wherein each of said one or more exterior panel folding tab sections are configured to rotate about a fold line to surround a plurality of individual compartments.

6. The partition container of claim 5, wherein:

a plurality of exterior panel folding tabs are configured to interlock with one another to cover a plurality of individual compartments.

7. The partition container of claim 1, wherein:

at least one of said folding tab sections extends substantially across an entire width of an individual compartment of said individual compartments.

8. The partition container of claim 1, wherein:

each folding tab section of said second number of interior partitions adjacent to a substantially parallel exterior panel wall extends from a top edge of said partitioning section to an intermediate height thereof; and each folding tab section of said second number of interior partitions positioned between each of said second number of interior partitions adjacent to a substantially parallel exterior wall extends from a bottom edge of said partitioning section to an intermediate height thereof.

9. The partition container of claim 1, wherein:

said one or more exterior panels further comprise a plurality of walls, and wherein:

each of said first number of interior partitions adjacent to a substantially parallel exterior panel wall is substantially identical to one another, having a first slot configuration;

each of said first number of interior partitions positioned between each of said first number of interior partitions adjacent to a substantially parallel exterior panel wall is substantially identical to one another, having a second slot configuration;

each of said second number of interior partitions adjacent to a substantially parallel exterior panel wall is substantially identical to one another, having a third slot configuration; and each of said second number of interior partitions positioned between each of said second number of interior partitions adjacent to a substantially parallel exterior wall is substantially identical to one another, having a fourth slot configuration.

10. The partition container of claim 1, wherein:

said number of slots of each of said first number of interior partitions are spaced apart from one another and at least partially define a plurality of panel tabs, each comprising non-right-angle corners along an open edge; and said number of slots of each of said second number of interior partitions are spaced apart from one another and at least partially define a plurality of panel tabs, each comprising non-right-angle corners along an open edge.

11. The partition container of claim 1, wherein:

said interior compartment is cuboid in shape.

12. A partitioned container comprising:

one or more exterior panels defining an interior compartment;

a first number of interior partitions, each comprising:

a top edge and a bottom edge;

a pair of side edges;

a partitioning section comprising a top edge and a bottom edge, and a pair of side edges, and comprising a number of slots extending from both of said top and bottom edges to an intermediate height thereof;

wherein each of said partitioning sections extend alongside one another and substantially cross said interior compartment in a first direction;

a second number of interior partitions, each comprising:

a top edge and a bottom edge;

a pair of side edges;

a partitioning section, comprising a top edge and a bottom edge, and a pair of side edges, and comprising a number of slots extending from both of said top and bottom edges to an intermediate height thereof;

at least one folding tab section extending from either side edge of said partitioning section, comprising a top edge and a bottom edge, and a pair of side edges, and configured for folding about a vertically extending fold line located at said either side edge of said partitioning section;

wherein each of said partitioning sections extend alongside one another and substantially cross said interior compartment in a second direction intersecting said first direction;

wherein each of said folding tab sections are attached to one of said one or more exterior panels;

wherein each of said partitioning sections of each of said first number of interior partitions are mated with each of said partitioning sections of each of said second number of interior partitions by way of said slots in said partitioning sections of said first and second number of interior partitions to define a series of individual compartments within the interior compartment;

wherein vertical and horizontal movement with respect to said one or more exterior panels of each of said first number of interior partitions is restricted by said partitioning sections of said second number of interior partitions mated thereto;

wherein vertical and horizontal movement with respect to said one or more exterior panels of each of said second number of interior partitions is restricted by said partitioning sections of said first number of interior partitions mated thereto;

wherein each of said second number of interior partitions adjacent to a substantially parallel exterior wall is substantially identical to one another, having a first slot configuration, and each of said second number of interior partitions positioned between each of said second number of interior partitions adjacent to a substantially parallel exterior wall is substantially identical to one another, having a second slot configuration;

wherein said interior partitions having said first slot configuration include a pair of first slots each adjacent to a folding tab section and a plurality of second slots each positioned between each of said first slots, wherein said first slots each extend from a top edge of said partitioning section to an intermediate height thereof, and wherein said second slots each extend from a bottom edge of said partitioning section to an intermediate height thereof; and wherein said interior partitions having said second slot configuration include a pair of first slots each adjacent to a folding tab section and a plurality of second slots each positioned between each of said first slots, wherein said first slots each extend from a bottom edge of said partitioning section to an intermediate height thereof, and wherein said second slots each extend from a top edge of said partitioning section to an intermediate height thereof.

13. A partitioned container comprising:

one or more exterior panels defining an interior compartment, said one or more exterior panels comprising a plurality of walls;

a first number of interior partitions, each comprising:

a partitioning section comprising a number of slots extending from each of a top and bottom edge to an intermediate height thereof;

a free edge at each side edge of said first number of interior partitions;

wherein each of said partitioning sections extend alongside one another and substantially cross said interior compartment in a first direction;

a second number of interior partitions, each comprising:

a partitioning section comprising a number of slots extending from each of a top and bottom edge to an intermediate height thereof;

a first folding tab section, including a pair of side edges and extending from a right-side edge of the partitioning section in a first direction, and configured for folding about a vertically extending fold line located at said right-side edge;

a second folding tab section, including a pair of side edges and extending from a left-side edge of the partitioning section in a second direction opposing said first direction, and configured for folding about a vertically extending fold line located at said left-side edge;

wherein each of said partitioning sections extend alongside one another and substantially cross said interior compartment in a second direction intersecting said first direction;

wherein each of said first folding tab sections and each of said second folding tab sections are attached to one of said one or more exterior panels; and wherein each of said partitioning sections of each of said first number of interior partitions are mated with each of said partitioning sections of each of said second number of interior partitions by way of said slots in said partitioning sections of said first and second number of interior partitions to define a series of individual compartments within the interior compartment;

wherein said number of slots of each of said first and second number of interior partitions are spaced apart from one another and at least partially define a plurality of panel tabs, each comprising non-right-angle corners along an open edge;

wherein upward, downward, and side-to-side movement of each of said first number of interior partitions with respect to said one or more exterior panels is restricted by said partitioning sections of said second number of interior partitions mated thereto;

wherein upward, downward, and side-to-side movement of each of said second number of interior partitions with respect to said one or more exterior panels is restricted by said partitioning sections of said first number of interior partitions mated thereto;

wherein said partitioned container is configured for folding about fold lines such that adjacent ones of said first number of interior partitions or second number of interior partitions are configured to selectively contact one another;

wherein said fold line of said first folding tab section extends a fraction of a height of said right side-edge, and a remainder of said right-side edge is an open edge;

wherein said fold line of said second folding tab section extends a fraction of a height of said left-side edge, and a remainder of said left-side edge is an open edge; and wherein at least one of said folding tab sections extends substantially across an entire width of an individual compartment of said individual compartments.

14. The partition container of claim 13, wherein said interior compartment is cuboid in shape.

* * * * *